US010498071B2

(12) United States Patent
Wang et al.

(10) Patent No.: US 10,498,071 B2
(45) Date of Patent: Dec. 3, 2019

(54) PORT FOR ELECTRONIC DEVICE

(71) Applicant: BOE TECHNOLOGY GROUP CO., LTD., Beijing (CN)

(72) Inventors: Zifeng Wang, Beijing (CN); Yan Ren, Beijing (CN); She Lin, Beijing (CN); Lei Cao, Beijing (CN); Nannan Hu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/563,598

(22) PCT Filed: Jun. 16, 2017

(86) PCT No.: PCT/CN2017/088650
§ 371 (c)(1),
(2) Date: Oct. 1, 2017

(87) PCT Pub. No.: WO2018/045786
PCT Pub. Date: Mar. 15, 2018

(65) Prior Publication Data

US 2019/0190189 A1 Jun. 20, 2019

(30) Foreign Application Priority Data

Sep. 7, 2016 (CN) ..... 2016 1 0808772

(51) Int. Cl.
*H01R 13/52* (2006.01)
*H04R 3/00* (2006.01)
*H01R 24/58* (2011.01)

(52) U.S. Cl.
CPC ..... *H01R 13/5213* (2013.01); *H01R 13/5216* (2013.01); *H04R 3/00* (2013.01); *H01R 24/58* (2013.01); *H04R 2420/09* (2013.01)

(58) Field of Classification Search
CPC ... H01R 13/5213; H01R 13/5216; H01R 3/00
(Continued)

(56) References Cited

U.S. PATENT DOCUMENTS 5,944,542 A * 8/1999 Lee ..... H01R 13/4538 439/140
8,096,819 B1 * 1/2012 Rosero ..... H01R 13/4536 439/135

(Continued)

FOREIGN PATENT DOCUMENTS

CN 201708290 U 1/2011
CN 203826667 U 9/2014

(Continued)

OTHER PUBLICATIONS

International Search Report and Written Opinion in PCT/CN2017/088650 dated Aug. 18, 2017.

*Primary Examiner* — Alexander Gilman
(74) *Attorney, Agent, or Firm* — Syncoda LLC; Feng Ma

(57) ABSTRACT

A port for an electronic device that is water and dust resistant is provided herein. The port includes a housing having a holding hole and an elastic member in the housing. The housing contains a holding hole, and the elastic member is disposed in the housing. The elastic member can snugly block the holding hole in a memory shape, and is configured to deform upon a plug entering the holding hole to thereby expose, and to allow an electrical connection of the plug to, at least one conducting end inside the housing; and is also configured to return to the memory shape to thereby snugly block the holding hole upon the plug exiting the holding hole. An electronic device having one or more of the ports is further provided in the disclosure.

19 Claims, 7 Drawing Sheets

(58) Field of Classification Search
USPC ..... 439/135
See application file for complete search history.

(56) References Cited

U.S. PATENT DOCUMENTS

| | | | | |
|---|---|---|---|---|
| 8,790,123 | B2 * | 7/2014 | Ku | H01R 24/68 439/106 |
| 9,130,302 | B1 * | 9/2015 | Yang | H01R 13/521 |
| 9,225,105 | B2 * | 12/2015 | Cheong | H01R 13/5213 |
| 9,531,111 | B2 * | 12/2016 | Chen | H01R 24/58 |
| 9,548,574 | B2 * | 1/2017 | Hsu | H01R 13/7038 |
| 9,684,346 | B2 * | 6/2017 | Yen | G06F 1/188 |
| 9,692,170 | B2 * | 6/2017 | Choi | H01R 13/5202 |
| 9,948,020 | B1 * | 4/2018 | Lin | H01R 13/447 |
| 10,141,699 | B1 * | 11/2018 | Pope | H01R 13/516 |
| 2010/0313485 | A1 * | 12/2010 | Kuo | A45C 5/03 49/484.1 |
| 2011/0195611 | A1 * | 8/2011 | Little | H01R 13/52 439/668 |
| 2011/0256744 | A1 | 10/2011 | Wang | |
| 2013/0183867 | A1 * | 7/2013 | Wu | H01R 24/58 439/668 |
| 2013/0225008 | A1 * | 8/2013 | Liu | H01R 12/57 439/676 |
| 2013/0242481 | A1 * | 9/2013 | Kim | H05K 5/06 361/679.01 |
| 2013/0280961 | A1 * | 10/2013 | Cho | H01R 13/521 439/660 |
| 2014/0065890 | A1 * | 3/2014 | Cheng | H04M 1/03 439/668 |
| 2014/0093116 | A1 * | 4/2014 | Liu | H01R 24/58 381/384 |
| 2015/0155663 | A1 * | 6/2015 | Zwartkruis | H01R 13/5202 439/188 |
| 2015/0295347 | A1 * | 10/2015 | Nagata | H01R 24/58 439/587 |
| 2016/0049755 | A1 * | 2/2016 | Ning | H01R 24/58 439/587 |

FOREIGN PATENT DOCUMENTS

| | | | |
|---|---|---|---|
| CN | 203911096 | U | 10/2014 |
| CN | 105098467 | A | 11/2015 |
| CN | 205985461 | U | 2/2017 |

* cited by examiner

PORT FOR ELECTRONIC DEVICE

CROSS-REFERENCE TO RELATED APPLICATION

The present application claims priority to Chinese Patent Application No. 201610808772.7, filed on Sep. 7, 2016, the disclosure of which is hereby incorporated by reference in its entirety.

TECHNICAL FIELD

The present disclosure is related generally to ports for external components on an electronic device, and more specifically to a water-resistant port for an electronic device.

BACKGROUND

Currently, some electronic devices on the market have their dust-resistance and water-resistance as selling points. For example, an electronic device such as a mobile phone may be rated as "IP67," where IP stands for the International Protection marking, a standard drawn up by the International Electrotechnical Commission (IEC) and indicative of the protection capability of the electronic device to be resistant to liquid and solid particles. The first digit 6 in "IP67" stands for a resistance of the electronic device to solid particles such as dust, i.e., a rating for "no ingress of dust; complete protection against contact," in other words 'dust tight." To achieve such a rating, the electronic device needs to be configured such the gaps of outer shells of the electronic device are smaller than the diameters of typical dust particles. The second digit 7 stands for a resistance of the electronic device to liquid, such as water, in the case of immersion in the liquid with a depth of up to 1 meter for a short period of time (for example, 30 minutes). With no other special requirements, IP67 represents a highest rating for protection.

In order for an electronic device to reach a protection rating of IP67, the treatment of ports of the device is considered to be the most important aspect. For example, a headset and/or microphone port, such as a port on a mobile phone for connecting to a headset, needs attention in the design of the mobile phone. To prevent water from entering through the headset port, one approach is to completely block the port of the headset assembly, leaving only contacts (i.e., electronic contacts) being connected with the headset port.

Because the headset port is independently isolated from the main components and the motherboard, even under situations where water enters the headset port, the water cannot enter the inside of the mobile phone to damage the motherboard and other main components of the mobile phone.

One disadvantage of this above approach is that it has a high requirement of the manufacturing process. Especially because a headset assembly typically comprises a metal material and a plastic material, the control over manufacturing precision is very difficult due to the different thermal expansion and contraction properties of the two very different materials; and if gaps are configured to be too small, it is not easy for assembly. If a single molding process with a metal-plastic mold is adopted, there is a high requirement for the design, increasing the manufacturing cost.

In addition, as for the aforementioned closed-type of headset port, the level of water-resistance does not provide water protection to the headset port itself. If water has contacted the contact points inside the headset port, the headset cannot be used for at least a short period time. If the contact points are in water for a long period of time, the water can erode the contact points and adversely affect the transmission of audio signals.

SUMMARY

In order to address the issues as mentioned above that are associated with current technologies, the present disclosure provides a port for an electronic device that is water resistant and/or dust resistant.

In a first aspect, a port for an electronic device is disclosed. The port includes a housing having a holding hole and an elastic member in the housing. The elastic member is configured to snugly block the holding hole in a memory shape, and is further configured to deform upon a plug entering the holding hole to thereby expose, and to allow an electrical connection of the plug to, at least one conducting end inside the housing; and to return to the memory shape to thereby snugly block the holding hole upon the plug exiting the holding hole.

In the port, the elastic member includes a main portion, a connecting portion, and a position-limiting portion. The connecting portion is disposed between, and connects, the main portion and the position-limiting portion; the main portion is in, and configured to snugly block, the holding hole of the housing; and the position-limiting portion is mounted to the housing.

According to some embodiments, in the elastic member of the port, the main portion, the connecting portion, and the position-limiting portion are an integrated piece.

In the port as described above, the elastic member can have a composition of thermal plastic rubber (TPR).

According to some embodiments of the port, the connecting portion includes a spring. The spring is configured to contract to allow the main portion to withdraw if the plug is inserted into the holding hole such that the plug is electrically connected to the at least one conducting end, and the spring is also configured to expand back to allow the main portion to snugly block the holding hole if the plug is pulled out of the holding hole.

According to some embodiments of the port, the elastic member further includes a buffering portion disposed between the main portion and the connecting portion. The buffering portion is configured to prevent the elastic member from being squeezed to an outside of the second member when the plug is inserted in the holding hole.

According to some embodiments of the port, the housing includes a first member and a second member. The holding hole is arranged in the first member. The second member is provided with a connecting hole and a position-limiting groove, wherein the connecting hole is configured for positioning the connecting portion of the elastic member; and the position-limiting groove is arranged on an end of the second member opposing to the first member, and is configured for fittingly positioning the position-limiting portion of the elastic member.

In the port as described above, a groove can be arranged on a sidewall of the second member. The groove is spatially connected with the connecting hole and is configured to allow the connecting portion of the elastic member to be positioned in the connecting hole of the second member.

In the port as described above, the first member and the second member can be detachably connected. Accordingly, the first member can further include a protruding portion, which is configured such that the protruding portion fittingly snaps with the groove of the second member to allow a tight assembly of the first member and the second member.

According to some embodiments, the second member further includes a position-limiting plate, which is disposed opposing to the connecting hole and is configured to block the position-limiting portion of the elastic member upon application of an external force to the main portion of the elastic member.

According to some other embodiments, the at least one connecting end is disposed inside the holding hole of the first member; and the first member further includes at least one pin, electrically connected with the at least one conducting end in a corresponding manner.

In the embodiments of the port as described above, the at least one pin of the first member can include a first pin, a second pin, and a third pin. The first pin and the second pin can be respectively disposed on two sides of the first member and on a position close to the second member; and the third pin is disposed on a side of the first member corresponding to an opening of the holding hole that is close to the second member.

According to some embodiments of the port, one end of the main portion of the elastic member opposing to the position-limiting portion is provided with an outer surface, which is configured to be customizable. Herein "customizable" is referred to the situation where the outer surface can have different designs.

According to some embodiments of the port, the housing comprises an integrated member, and the holding hole is arranged in the integrated member, and the position-limiting portion of the elastic member is mounted onto the integrated member.

In any embodiment of the port as mentioned above, the port can be an audio port or a video port.

In embodiments where the port is an audio port, the plug can be from a headset.

In a second aspect, the disclosure further provides an electronic device having one or more ports, and each port can be based on any embodiment of the port as described above.

Other embodiments may become apparent in view of the following descriptions and the attached drawings.

BRIEF DESCRIPTION OF THE DRAWINGS

To more clearly illustrate some of the embodiments, the following is a brief description of the drawings. The drawings in the following descriptions are only illustrative of some embodiment. For those of ordinary skill in the art, other drawings of other embodiments can become apparent based on these drawings.

DETAILED DESCRIPTION

In the following, with reference to the drawings of various embodiments disclosed herein, the technical solutions of the embodiments of the disclosure will be described in a clear and fully understandable way.

Figure 1:
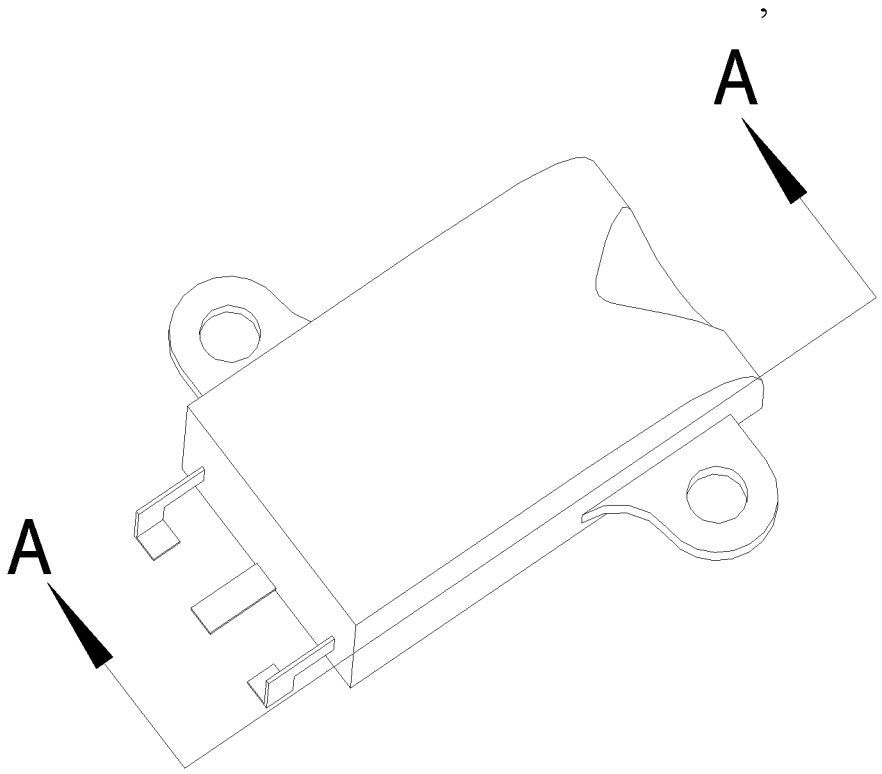
FIG. 1 (PRIOR ART)
FIG. 1 is a schematic diagram of a headset port in a conventional mobile phone.
Figure 2:
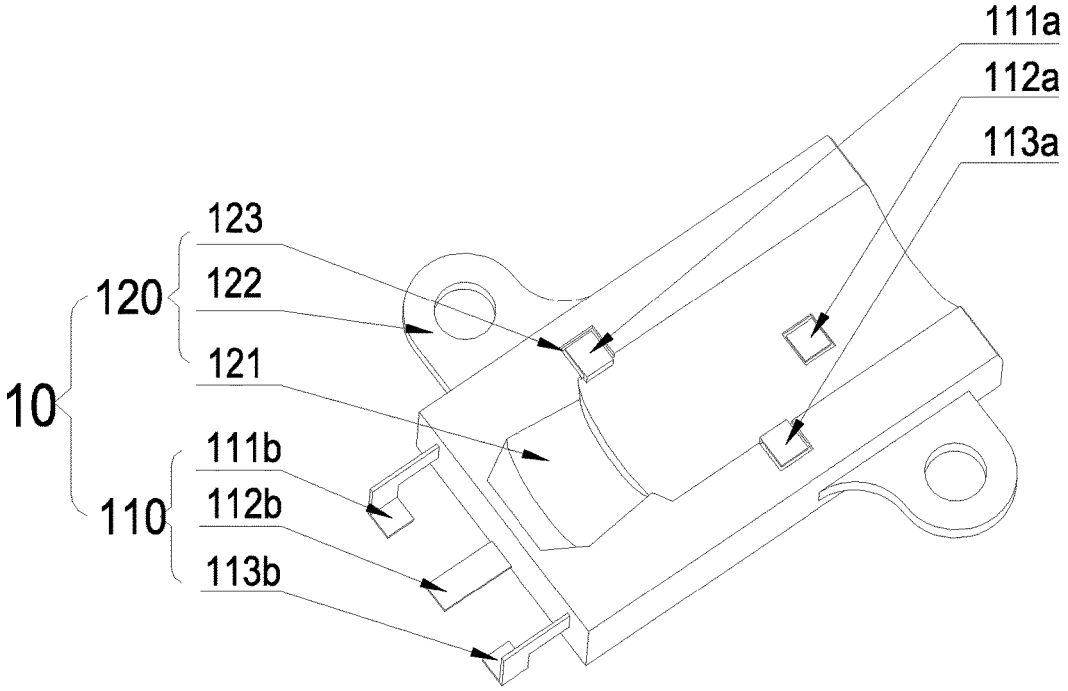
FIG. 2 (PRIOR ART)
FIG. 2 is a cross-sectional view of the headset port shown FIG. 1 along a direction of A-A'.

FIG. 1 and FIG. 2 illustrate a conventional port, such as a headset port, of an existing mobile phone. As shown in the figures, the conventional port comprises a main body 120 having a plastic composition, and a metal member 110 configured to mediate a transmission of electrical signals. The main body 120 comprises a headset slot 121, a mounting member 122 configured to mount the main body 120 with other components of the mobile phone, and a headset contact slot 123.

The metal member 110 can include one or more sprint-loaded metal portions such metal plates or stripes. The different metal portions of the metal member 110 are not necessarily electrically connected to each other.

For example, the metal member 110 comprises contact points 111*a*, 112*a*, and 113*a*, which correspond to a left audio track, a right audio track, and a microphone of the headset, respectively. Another end of the metal member 110 is provided with pins 111*b*, 112*b*, and 113*b*, serving respectively as welding points to connect the motherboard of the mobile phone.

In the conventional port as mentioned above, the main body 120 and the metal member 110 are assembled together by means of a slot insertion. The gap between the contact slot 123 and the contact points 111*a* substantially forms a channel allowing water vapor and other potential contaminants to enter into the inside of the mobile phone.

To address the aforementioned issues of the conventional port, the present disclosure provides a water-resistant port for an electronic device.

Figure 3:
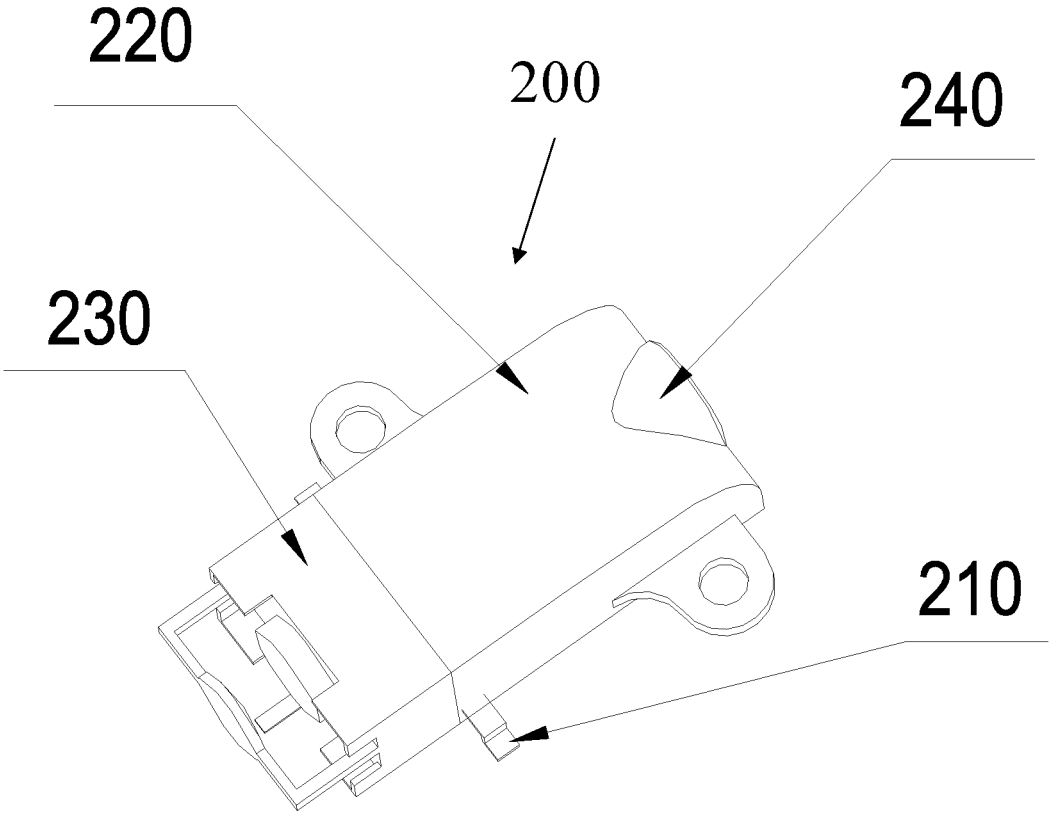
FIG. 3 is a schematic diagram of a port according to a first embodiment of the present disclosure.

FIG. 3 illustrates a first embodiment of the port. As shown in the figure, the port comprises a housing 200 and an elastic member 240, wherein the elastic member 240 is disposed inside the housing 200. The elastic member 240 is configured to be able to move under an external force to thereby expose a conducting end inside the housing and to move back to an initial position upon removal of the external force.

Compared with the conventional port, because the elastic member 240 is disposed in the housing 200, when a headphone and/or microphone connector, also known as a phone jack or jack plug, is inserted into the inside of the housing of the port upon application of an external force, the elastic member 240 contracts, exposing a conducting end to thereby electrically connect the plug and the conducting end. Upon removal of the plug out of the port, the elastic member 240 can rebound to the initial position, enclosing the inside of the housing to thereby realize the functionality of water-resistance.

The elastic member 240 can have a composition of thermal plastic rubber (TPR), but can have a different composition as long as the composition has a similar characteristic as the TPR. There are no limitations herein.

The housing 200 of the port according to the first embodiment as described above can comprise a first member 220 and a second member 230, which can be detachably connected. The elastic member 240 can be configured to run through the first member 220 and the second member 230.

Figure 4:
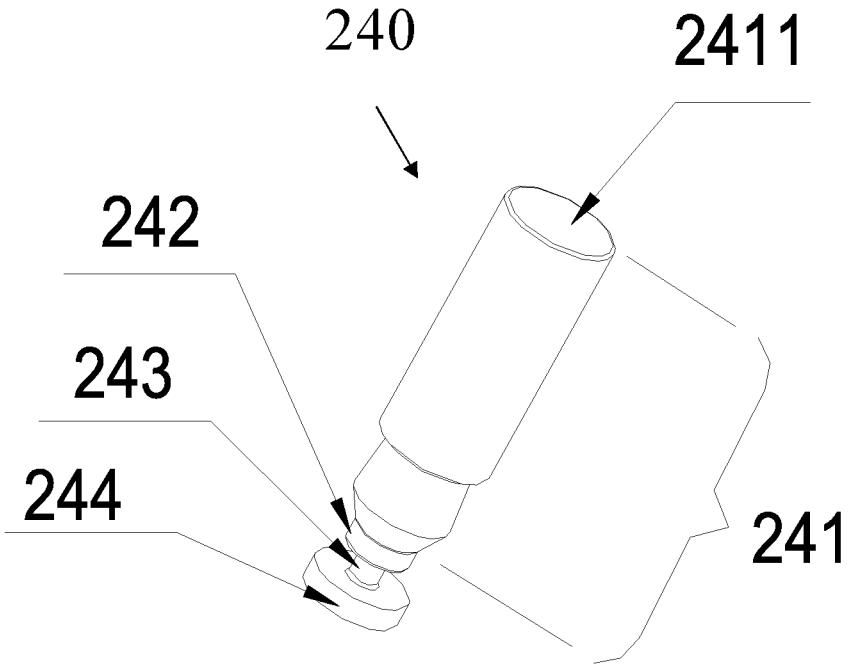
FIG. 4 illustrates the elastic member of the port according to the first embodiment of the present disclosure.

As shown in FIG. 4, the elastic member 240 can comprise a main portion 241, a connecting portion 243, and a position-limiting portion 244.

Figure 7:
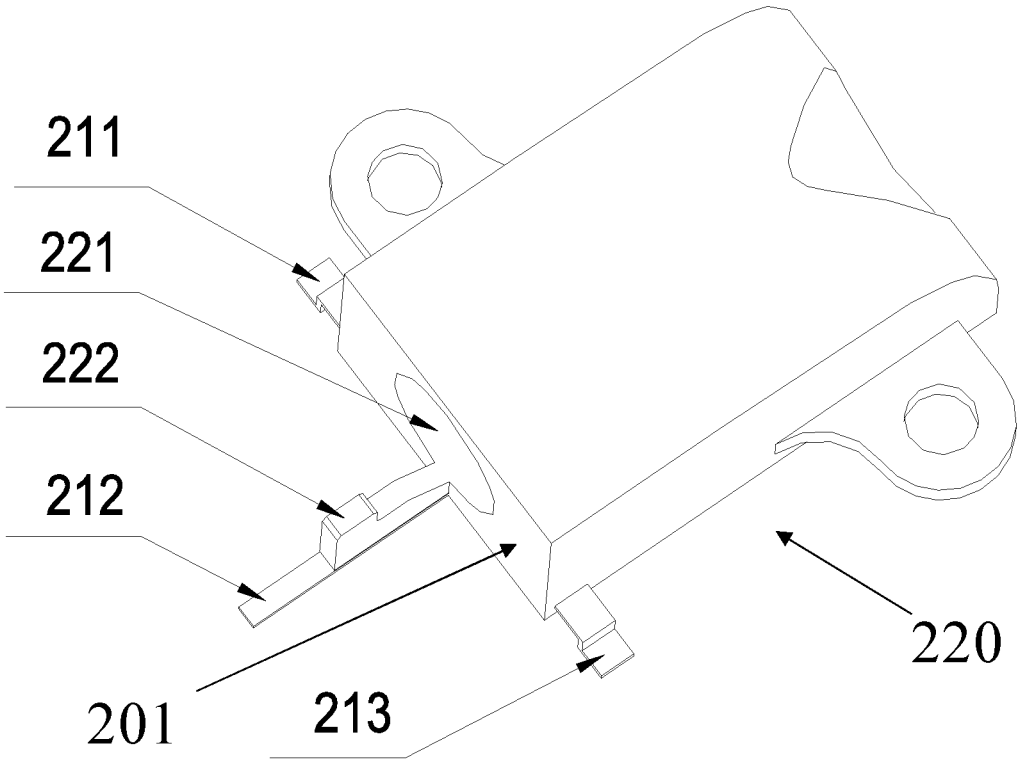
FIG. 7 illustrates the first member of the port according to the first embodiment of the present disclosure.

The first member 220 of the housing 200 can comprise a first body 201, which is provided with a holding hole 221, as shown in FIG. 7. The holding hole 221 is configured to provide a space for fittingly positioning the main portion 241 of the elastic member 240 therein.

Figure 5:
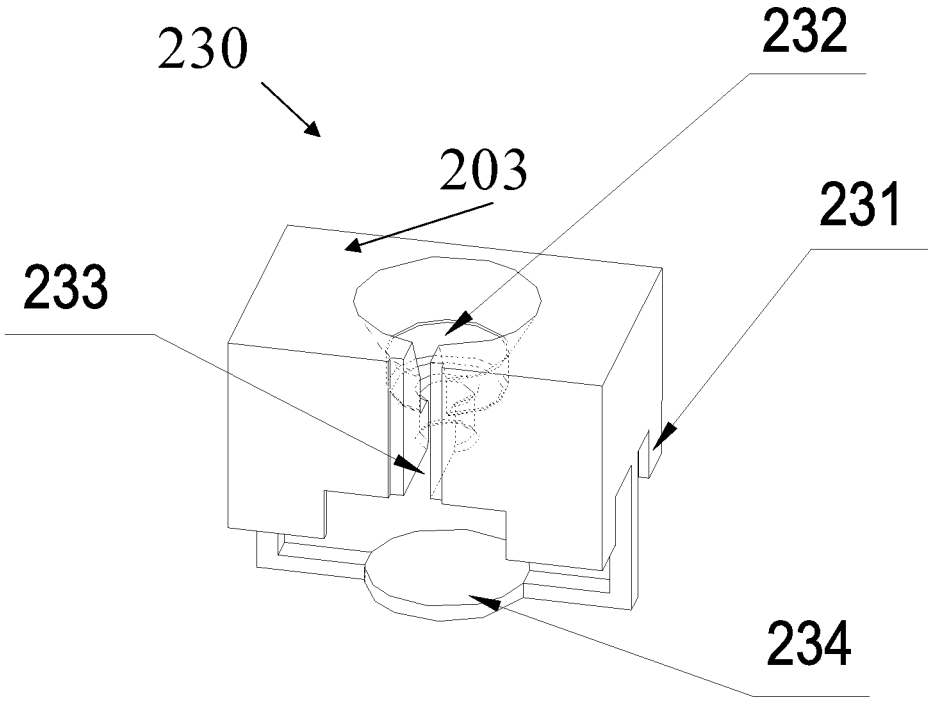
FIG. 5 illustrates the second member of the port according to the first embodiment of the present disclosure.

As shown in FIG. 5, the second member 230 comprises a second body 203, which is provided with a connecting hole 232. The second body 203 is further provided with a groove 233 on a first side wall of the second body 203, and the groove 233 is arranged to spatially connect the connecting hole 232. A position-limiting beam 231 is arranged on an end of the second body 203 opposing to the first member 220.

In some embodiments, the connecting portion 243 of the elastic member 240 is configured to be squeezed into the connecting hole 232 of the second member 230 through the groove 233 to thereby allow the position-limiting portion 244 of the elastic member 240 to be fittingly positioned in the position-limiting beam 231 of the second member 230.

FIG. 4 illustrates a 3D diagram of the elastic member 240 in a memory form, configured such that the elastic member 240 can return to the memory form if the external force that has been applied on the elastic member 240 is removed.

In the port as described above, the main portion 241 of the elastic member 240 is fittingly positioned in the holding hole 221 of the first member 220, as illustrated in FIG. 7. When the headset is not yet plugged in, because of the block of holding hole 221 of the first member 220 by the main portion 241 of the elastic member 240, water vapor or other potential contaminant from an outside environment can be prevented from entering in the holding hole 221 of the first member 220.

One end of the main portion 241 of the elastic member 240 opposing to the position-limiting portion 244 is provided with an outer surface 2411, which is configured to be outside the holding hole 221, and can be surface-treated to match the shape and color of the electronic device depending on practical needs.

The elastic member 240 further comprises a buffering portion 242, which is disposed between the main portion 241 and the connecting portion 243 and is configured to prevent the elastic member 240 from being squeezed to an outside of the second member 230 when a plug is inserted in the port.

The connecting portion 243 of the elastic member 240 is configured to deform when the plug is inserted, releasing the part of the elastic member 240 under squeeze to move aside.

The position-limiting portion 244 of the elastic member 240 is configured to anchor the elastic member 240 to the second member 230 such that the elastic member 240 is not loosened from the second member 230.

FIG. 5 illustrates the structure of the second member 230 according to a specific embodiment of the present disclosure. As shown in the figure, in addition to the second body 203 that comprises the connecting hole 232, the groove 233, and the position-limiting beam 231, the second member 230 further comprises a position-limiting plate 234. The position-limiting plate 234 is disposed opposing to the connecting hole 232 and is configured to block the position-limiting portion 244 of the elastic member 240 upon application of an external force to the main portion 241 of the elastic member 240.

The position-limiting beam 231 and the position-limiting plate 234 of the second member 230 together form a position-limiting structure. When a plug is inserted into the port, the elastic member 240 is deformed under the squeezing force, and via the connecting hole 232 of the second member 230, the main portion 241 of the elastic member 240 is translocated to a space of the second member 230 that is defined by the position-limiting beam 231 and the position-limiting plate 234. When the plug is pulled out of the port, the elastic member 240 returns to the original memory form to thereby again block the holding hole 221 of the first member 220.

Figure 6:
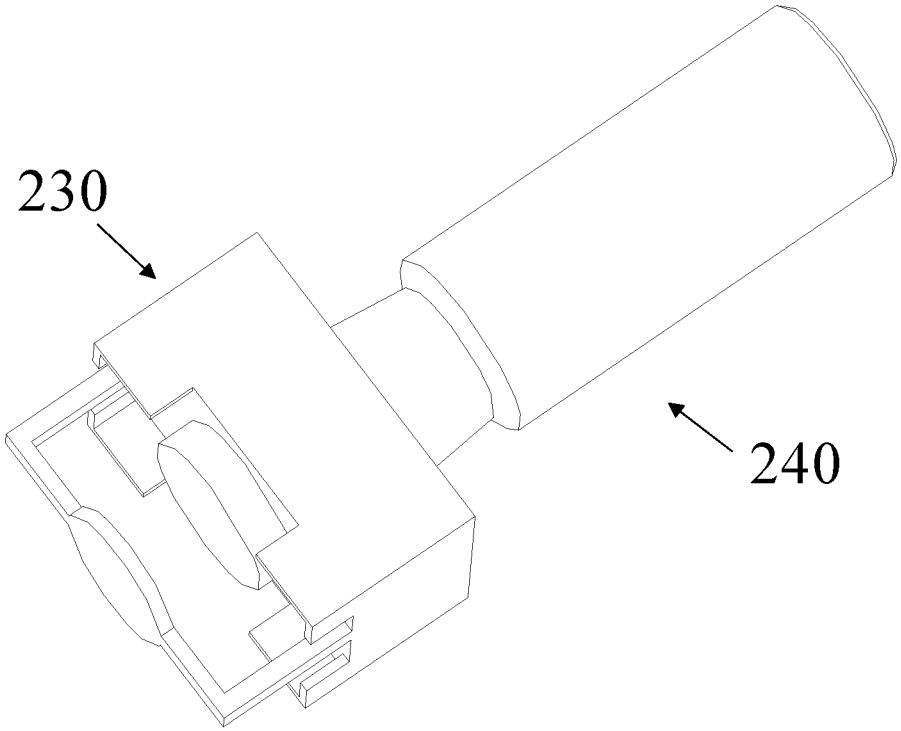
FIG. 6 is a schematic diagram of an assembly of the elastic member and the second member of the port according to the first embodiment of the present disclosure.

The groove 233 is configured to have the connecting portion 243 of the elastic member 240 inserted therethrough and into the second member 230 during assembly. FIG. 6 illustrates a schematic diagram of an assembly of the elastic member 240 and the second member 230 of the port according to the first embodiment of the present disclosure.

As shown in FIG. 7, the first member 220 further comprises a protruding portion 222, which protrudes from the first body 201 of the first member 220 and is configured to fittingly snap with the groove 233 of the second body 203 of the second member 230 during assembly of the first member 220 and the second member 230. Such a configuration allows a tight assembly of the first member 220 and the second member 230 to thereby prevent water vapor and other potential contaminants from entering into the inside of the port.

At least one connecting end inside the port is disposed in the holding hole 221 of the first body 201 of the first member 220. The first body 201 further comprises at least one pin 210, which is configured to electrically connect the at least one conducting end in a corresponding manner.

FIG. 7 illustrates a schematic diagram of the first body 201 of the first member 220, and the at least one pin 210 according to some embodiments of the present disclosure. As shown, the at least one pin can comprise a first pin 211, a second pin 212, and a third pin 213, which are arranged to match with the structure of the first member 220 and configured to electrically connect the corresponding conducting ends respectively.

In the embodiment as shown in FIG. 7, the first pin 211 and the second pin 212 are respectively disposed on two sides of the first body 201 of the first member 220, and at a position that is close to the second body 203 of the second member 230. The third pin 213 is disposed on an end of the holding hole 221 of the first body 201 that is close to the second body 203 of the second member 230, a configuration that is convenient for welding.

The main portion 241 of the elastic member 240 is configured to be inserted into the holding hole 221 for assembly, and the protruding portion 222 of the first member 220 is configured to correspondingly fit with the groove 233 of the second member 230 for packaging. The two contacting surfaces between the first member 220 and the second member 230 can be configured to be attached together via at least one internal slot.

A connecting end of the headset can be inserted from a side corresponding to the outer surface 2411 of the elastic member 240. The elastic member 240 can be deformed under a squeezing action, and via the connecting hole 232 of the second member 230, the main portion 241 of the elastic member 240 is thereby translocated to the space defined by the position-limiting beam 231 and the position-limiting plate 234.

When the connecting end of the headset is pulled out of the port, the elastic member 240 returns to its original memory form because of the memory feature of the composition of the elastic member 240. The headset port is thereby blocked, effectively preventing water and dirt from entering therethrough.

The outer surface 2411 on the main portion 241 of the elastic member 240 can be surface-treated to accord to the design of the mobile phone. This can compensate for the defects associated with the outer appearance of the headset port.

Although a composition of TPR is used as an example, the elastic member as described above can have a different configuration according to some other embodiments of the present disclosure.

In a second embodiment of the port, the elastic member can comprise a spring, a first end portion and a second end portion, wherein a first end of the spring is connected to the first end portion, and a second end of the spring is connected to the second end portion. In this embodiment, other members or parts as mentioned above in the first embodiment of the port, including the first member and the second member, can still have similar shapes, configurations, and the manner of assembly.

The first end portion of the elastic member can have a shape similar, and have a function comparable, to the main portion 241 of the elastic member 240 in the first embodiment of the port, and can be fittingly positioned to the holding hole 221 and configured to block the holding hole 221 to thereby prevent water vapor and dirt from getting inside the housing when a headset is not plugged in the port.

The spring is configured to provide a support to the first end portion of the elastic member such that the first end portion can be fittingly positioned to, and thereby block, the holding hole 221 when the headset is not plugged in the port, and is also configured to contract under an external force when the headset is plugged in such that a conducting end can be exposed to allow an electrical coupling between the headset and the conducting end.

The second end portion of the elastic member can have a shape similar, and be functionally comparable, to the position-limiting portion 244 of the elastic member 240 in the first embodiment of the port, and is configured to anchor the elastic member to the second member of the port.

In both the first embodiment and the second embodiment of the port as described above, the housing can have two separate members (i.e., the first member 220 and the second member 230) which are detachably connected to form an assembly as illustrated in FIG. 3 to anchor or mount the elastic member 240. In some other embodiments of the present disclosure, one single piece (or member) that has a shape and configuration substantially identical to the assembly formed by the first member 220 and the second member 230 as mentioned above in the first embodiment and the second embodiment can be also possible. For example, the single member can be integrally manufactured by a 3D printing to thereby take the shape and the configuration allowing the elastic member to anchor or mount to the single member.

Besides the aforementioned illustrating embodiments, the port as described above can be arranged on an electronic device for connecting an external component. The port can be an audio port, a video port, or a port for connecting an external component.

In a second aspect, an electronic device having one or more of the water-resistant ports is provided. The electronic device can be, for example, a mobile phone, a portable video/music player such as an MP3 player, etc.

Although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the exemplary embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

The invention claimed is:

1. A port, comprising:

a housing having a holding hole; and an elastic member in the housing and configured to snugly block the holding hole in a memory shape;

wherein:

the elastic member is configured:

to deform upon a plug entering the holding hole to thereby expose, and to allow an electrical connection of the plug to, at least one conducting end inside the housing; and to return to the memory shape to thereby snugly block the holding hole upon the plug exiting the holding hole;

wherein the elastic member comprises:

a main portion;

a connecting portion; and a position-limiting portion, wherein:

the connecting portion is between, and connects, the main portion and the position-limiting portion;

the main portion is in, and configured to snugly block, the holding hole of the housing; and the position-limiting portion is mounted to the housing.

2. The port of claim 1, wherein in the elastic member, the main portion, the connecting portion, and the position-limiting portion are an integrated piece.

3. The port of claim 2, wherein the elastic member has a composition of thermal plastic rubber (TPR).

4. The port of claim 1, wherein the connecting portion is configured to:

contract to allow the main portion to withdraw if the plug is inserted into the holding hole such that the plug is electrically connected to the at least one conducting end; and expand back to allow the main portion to snugly block the holding hole if the plug is pulled out of the holding hole.

5. The port of claim 1, wherein the elastic member further comprises a buffering portion, disposed between the main portion and the connecting portion and configured to prevent the elastic member from being squeezed to an outside of the second member when the plug is inserted in the holding hole.

6. The port of claim 1, wherein the housing comprises a first member and a second member, wherein:

the holding hole is arranged in the first member;

the second member is provided with a connecting hole and a position-limiting groove, wherein:

the connecting hole is configured for positioning the connecting portion of the elastic member; and the position-limiting groove is arranged on an end of the second member opposing to the first member, and is configured for fittingly positioning the position-limiting portion of the elastic member.

7. The port of claim 6, wherein a groove is on a sidewall of the second member, wherein:

the groove is spatially connected with the connecting hole and is configured to allow the connecting portion of the elastic member to be positioned in the connecting hole of the second member.

8. The port of claim 7, wherein the first member and the second member are detachably connected.

9. The port of claim 8, wherein the first member further comprises a protruding portion, configured such that the protruding portion fittingly snaps with the groove of the second member to allow a tight assembly of the first member and the second member.

10. The port of claim 6, wherein the second member further comprises a position-limiting plate, disposed opposing to the connecting hole and configured to block the position-limiting portion of the elastic member upon application of an external force to the main portion of the elastic member.

11. The port of claim 6, wherein:

the at least one connecting end is disposed inside the holding hole of the first member; and the first member further comprises at least one pin, electrically connected with the at least one conducting end in a corresponding manner.

12. The port of claim 11, wherein the at least one pin of the first member comprises a first pin, a second pin, and a third pin.

13. The port of claim 12, wherein:

the first pin and the second pin are respectively disposed on two sides of the first member and on a position close to the second member; and the third pin is disposed on a side of the first member corresponding to an opening of the holding hole that is close to the second member.

14. The port of claim 1, wherein one end of the main portion of the elastic member opposing to the position-limiting portion is provided with an outer surface, configured to be customizable.

15. The port of claim 1, wherein the housing comprises an integrated member, wherein the holding hole is arranged in the integrated member, and the position-limiting portion of the elastic member is mounted onto the integrated member.

16. The port of claim 1, wherein the port is an audio port or a video port.

17. The port of claim 16, wherein the port is an audio port.

18. The port of claim 17, wherein the plug is from a headset.

19. An electronic device, comprising the port according to claim 1.

* * * * *